US007809558B2

(12) United States Patent
Morii

(10) Patent No.: US 7,809,558 B2
(45) Date of Patent: Oct. 5, 2010

(54) VECTOR TRANSFORMATION APPARATUS AND VECTOR TRANSFORMATION METHOD

(75) Inventor: Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 762 days.

(21) Appl. No.: 11/718,555

(22) PCT Filed: Nov. 1, 2005

(86) PCT No.: PCT/JP2005/020129

§ 371 (c)(1),
(2), (4) Date: May 3, 2007

(87) PCT Pub. No.: WO2006/049179

PCT Pub. Date: May 11, 2006

(65) Prior Publication Data

US 2008/0126085 A1 May 29, 2008

(30) Foreign Application Priority Data

Nov. 4, 2004 (JP) ..... 2004-321248

(51) Int. Cl.
*G10L 19/02* (2006.01)

(52) U.S. Cl. ..... 704/222; 704/230

(58) Field of Classification Search ..... 704/222, 704/230

See application file for complete search history.

(56) References Cited

U.S. PATENT DOCUMENTS 5,581,652 A 12/1996 Abe et al.
6,895,375 B2 * 5/2005 Malah et al. ..... 704/219
2005/0163323 A1 7/2005 Oshikiri

FOREIGN PATENT DOCUMENTS

JP 06118995 4/1994
JP 8123495 5/1996
JP 2003323199 11/2003

OTHER PUBLICATIONS

Nakatoh, Y et al.; Generation of Broadband Speech from Narrowband speech using piecewise Linear Mapping; Proc European Conf. Speech Comm. and Technology, EUROSPEECH '97, 1997, pp. 6-9.*

(Continued)

*Primary Examiner*—Abul Azad
(74) *Attorney, Agent, or Firm*—Dickinson Wright PLLC

(57) ABSTRACT

There is provided a vector conversion device for converting a reference vector used for quantization of an input vector so as to improve a signal quality including audio. In this vector conversion device, a vector quantization unit (902) acquires a number corresponding to a decoded LPC parameter of a narrow band from all the code vectors stored in a code book (903). A vector dequantization unit (904) references the number of the code vector obtained by the vector quantization unit (902) and selects a code vector from the code book (905). A conversion unit (906) performs calculation by using a sampling-adjusted decoded LPC parameter obtained from an upsampling unit (901) and a code vector obtained from the vector dequantization unit (904), thereby obtaining a decoded LPC parameter of a broad band.

6 Claims, 11 Drawing Sheets

OTHER PUBLICATIONS

Yoshida, Y et al.; An Algorithm to Reconstruct Widband speech from Narrowband speech based on Coodbook Mapping; Proc. Intl. Conf. Spoken Language Processing, ICSLP '94, 1994; pp. 1591-1594.*
International Search Report dated Feb. 7, 2006.
T. Nomura et al., "A Bitrate and Bandwidth Scalable CELP Coder," Proceedings of the 1998 IEEE International Conference on Acoustics, Speech and Signal Processing. ICASSP '98. Seattle, WA, May 12-15, 1998; [IEEE International Conference on Acoustics, Speech and Signal Processing], New York, NY: IEEE, US, vol. 1, May 12, 1998, pp. 341-344.

* cited by examiner

VECTOR TRANSFORMATION APPARATUS AND VECTOR TRANSFORMATION METHOD

TECHNICAL FIELD

The present invention relates to vector transformation apparatus and a vector transformation method for transforming reference vectors used in vector quantization.

BACKGROUND ART

Compression technology is used in the field of wireless communication etc. in order to implement the transmission of speech and video signals in real time. Vector quantization technology is an effective method for compressing speech and video data.

In patent document 1, technology is disclosed that makes broadband speech signals from narrowband speech signals using vector quantization technology. In patent document 1, results of LPC analysis on input narrowband speech signals are vector-quantized using a narrowband codebook, the vectors are then decoded using a broadband codebook, and the resulting code is subjected to LPC synthesis so as to obtain a broadband speech signal.

Patent Document 1: Japanese Patent Application Laid-Open No. Hei. 6-118995.

DISCLOSURE OF INVENTION

Problems to be Solved by the Invention

However, patent document 1 discloses technology with the purpose of changing a narrowband speech signal to a broadband speech signal and does not presume the existence of various "input speech and input vectors that are to be encoded," and is for manipulating spectral parameters in such a manner as to provide an advantage that speech signal auditorily sounds broader. This means that a synthesized sound close to the input speech cannot be obtained with this related art example.

As a method for improving quality including sound, quantization/inverse quantization if input vectors can be considered using reference vectors in order to obtain an improvement in performance of vector quantization but patent document 1 described above only has the purpose of converting narrowband speech signals to broadband speech signals and a document disclosing the statistical properties of reference vectors and input vectors where reference vectors are transformed for use in vector quantization does not yet exist.

It is therefore an object of the present invention to provide vector transformation apparatus and a vector transformation method capable of transforming reference vectors used in input vector quantization in such a manner as to improve the quality of signals including speech.

Means for Solving the Problem

The vector transformation apparatus of the present invention transforms a reference vector used in quantization of an input vector and employs a configuration having: a first codebook that stores a plurality of first code vectors obtained by clustering vector space; a vector quantization section that acquires the number of a vector corresponding to the reference vector among the first code vectors stored in the first codebook; a second codebook that stores second code vectors obtained by performing statistical processing of a plurality of reference vectors for learning use corresponding to a plurality of input vectors for learning use per number; a vector inverse quantization section that acquires a second code vector corresponding to the number acquired at the vector quantization section among the second code vectors stored in the second codebook; and a transformation processing section that transforms the second code vector acquired at the vector inverse quantization section and acquires a transformed reference vector.

Furthermore, the vector transformation method of the present invention transforms a reference vector used in quantization of an input vector and includes: a first storage step of storing a plurality of first code vectors obtained by clustering vector space in a first codebook; a vector quantization step of acquiring the number of a vector corresponding to reference vector among the first code vectors stored in the first codebook; a second storage step of storing second code vectors obtained by performing statistical processing of a plurality of reference vectors for learning use corresponding to input vectors for learning use in a second codebook per said number; a vector inverse quantization step of acquiring the second code vector corresponding to the number acquired in the vector quantization step from the second code vectors stored in the second codebook; and a transformation processing step of transforming the second code vector acquired in the vector inverse quantization step and acquiring a transformed reference vector.

ADVANTAGEOUS EFFECT OF THE INVENTION

According to the present invention, it is possible to implement transformation processing using codebook mapping employing reference vectors having a correlation with input vectors, and the quality of signals including speech can be improved by improving quantization performance by using vector quantization using the transformation results.

BEST MODE FOR CARRYING OUT THE INVENTION

In the following description, an example is described of vector transformation apparatus of the present invention applied to a coder and decoder e for layered coding. In layered coding, first, a core coder carries out encoding and determines a code, and then an enhancement coder carries out coding of an enhancement code such that adding this code to the code of the core coder further improves sound quality, and the bit rate is raised by overlaying this coding in a layered manner. For example, if there are three coders (core coder of 4 kbps, enhancement coder A of 3 kbps, enhancement coder B of 2.5 kbps), sound is outputted using three types of bit rates of 4 kbps, 7 kbps, and 9.5 kbps. This is possible even during transmission. That is, it is possible to decode only the 4 kbps code of the core coder and output sound during transmission at a total of 9.5 kbps of the codes of the three coders, or decode only the 7 kbps code of the core coder and enhancement coder A and output sound. Therefore, with layered coding, it is possible to continue transmission of high quality speech with transmission capacity maintained broad even if the transmission capacity suddenly becomes narrow during transmission so that code is dropped, and a service can be provided for speech of mid-quality. As a result, using layered coding, it is possible to carry out communication over different networks and maintain quality without a trans codec.

Further, CELP is used as the coding mode for each coder and decoder used in the core layers and enhancement layers. In the following, a description is given using FIG. 1 and FIG. 2 of CELP that is the basic algorithm for coding/decoding.

Figure 1:
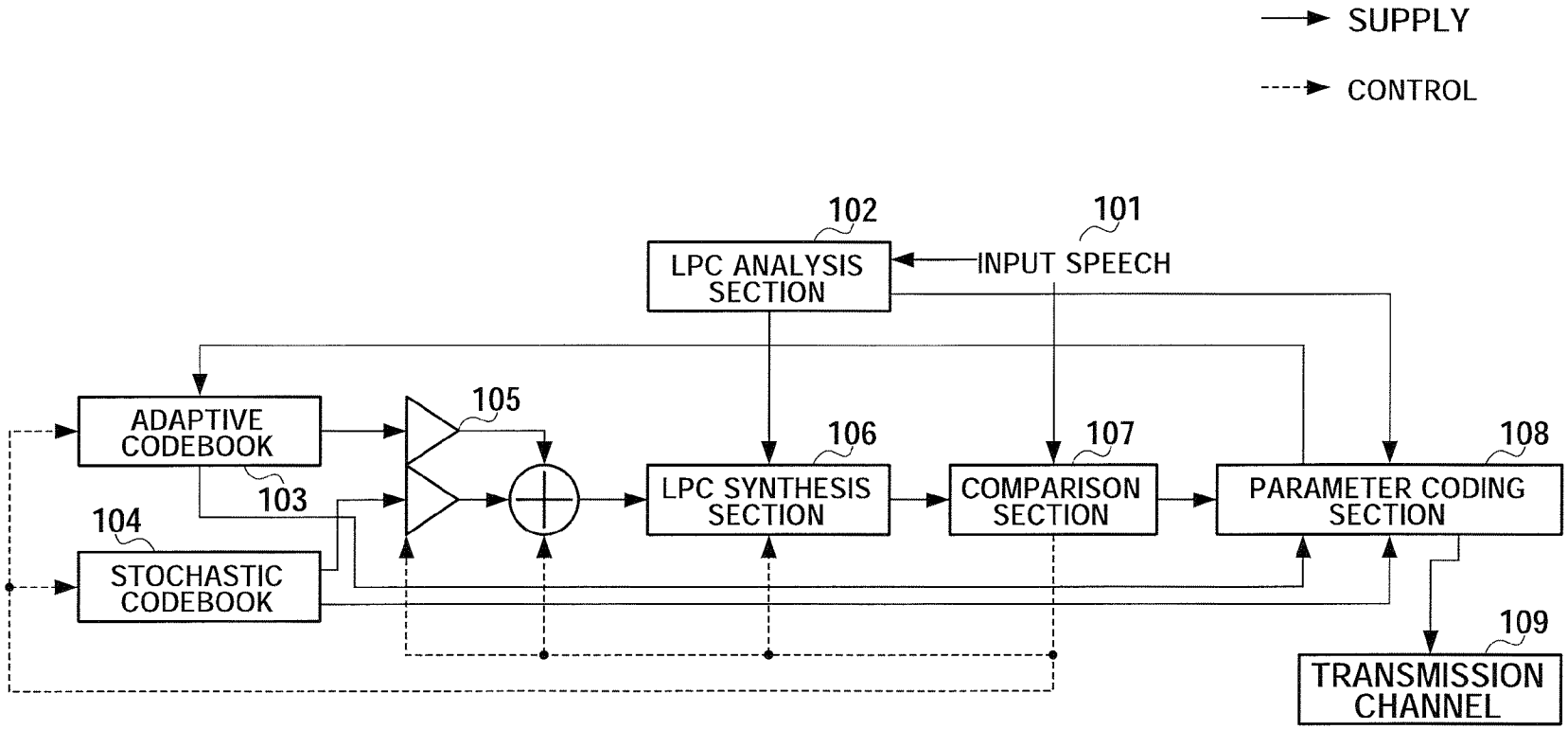
FIG. 1 is a block diagram of CELP coding apparatus.

First, a description is given using FIG. 1 of an algorithm for CELP coding apparatus. FIG. 1 is a block diagram showing CELP scheme coding apparatus.

First, LPC analysis section 102 obtains LPC coefficients by performing autocorrelation analysis and LPC analysis on input speech 101, obtains LPC code by encoding the LPC coefficients, and obtains decoded LPC coefficients by decoding the LPC code. In most cases, this coding is carried out by carrying out quantization using prediction and vector quantization using past decoded parameters, after transformation to parameters that are easy to quantize such as PARCOR coefficients, LSP and ISP.

Next, excitation samples designated within excitation samples (referred to as "adaptive code vector" or "adaptive excitation," "stochastic code vector" or "stochastic excitation") stored in adaptive codebook 103 and stochastic codebook 104 are extracted, and these excitation samples are amplified by a predetermined level at gain adjustment section 105 and then added together, thereby obtaining excitation vectors.

After this, at LPC synthesis section 106 synthesizes the excitation vectors obtained at gain adjustment section 105 by an all-pole filter using LPC parameters, and obtains a synthesized sound. However, with actual coding, two synthesized sounds are obtained by carrying out filtering using decoded LPC coefficients obtained at LPC analysis section 102 for two excitation vectors (adaptive excitation and stochastic excitation) for before gain adjustment. This is to carry out excitation coding more efficiently.

Next, comparison section 107 calculates the distance between the synthesized sounds obtained at LPC synthesis section 106 and input speech 101, and searches for a combination of codes of two excitations that give a minimum distance by controlling output vectors from the two codebooks and the amplification in multiplication in gain adjustment section 105.

However, with actual coding, it is typical to obtain a combination for an optimum value (optimum gain) for two synthesized sounds by analyzing a relationship between two synthesized sounds obtained by LPC synthesis section 106 and input speech, obtain total synthesized sound by adding respective synthesized sounds gain-adjusted by gain adjustment section 105 using this optimum gain, and then calculate the distance between this totally synthesized sound and the input speech. The distances between a large number of synthesized sounds obtained by functioning gain adjustment section 105 and LPC synthesis section 106 for all of the excitation samples of adaptive codebook 103 and stochastic codebook 104 are calculated and indexes for excitation samples giving the smallest distance are obtained. As a result, it is possible to efficiently search for the codes of the excitations of the two codebooks.

Further, with this excitation search, optimizing the adaptive codebook and the stochastic codebook at the same time would require an enormous amount of calculations and is practically not possible, and it is typical to carry out an open loop search whereby code is decided one at a time. Namely, the code for the adaptive codebook is obtained by comparing the synthesized sound for adaptive excitation only and input speech, fixing excitation from this adaptive codebook next, controlling excitation samples from the stochastic codebook, controlling excitation samples from the stochastic codebook, obtaining a large number of total synthesized sounds using combinations of optimized gain, and deciding the code for the stochastic codebook by making comparisons with input speech. As a result of the above procedure, it is possible to implement search using existing small-scale processors (DSP etc.).

Comparison section 107 then outputs indexes (codes) for the two codebooks, two synthesized sounds corresponding to the indexes, and input speech, to parameter coding section 108.

Parameter coding section 108 obtains gain code by encoding gain using correlation of the two synthesized sounds and the input speech. Indexes (excitation codes) for excitation samples for the two codebooks are then outputted together to transmission channel 109. Further, an excitation signal is decoded from gain code and two excitation samples corresponding to excitation codes and is stored in adaptive codebook 103. During this time, old excitation samples are discarded. Namely, decoded excitation data of the adaptive codebook 103 is shifted backward in memory, old data outputted from the memory is discarded, and excitation signals made by decoding are stored in the portions that become empty. This processing is referred to as state updating of an adaptive codebook.

With LPC synthesis upon excitation search at LPC synthesis section 106, it is typical to use an auditory weighting filter using linear prediction coefficients, high band emphasis filters, long term prediction coefficients (coefficients obtained by carrying out long term prediction analysis of input speech), etc. Further, excitation search for adaptive codebook 103 and stochastic codebook 104 is also commonly carried out by dividing analysis periods (referred to as "frames") into shorter periods (referred to as sub-frames).

Here, as shown in the above description, at comparison section 107, search is carried out by a feasible amount of calculations for all of the excitations for adaptive codebook 103 and stochastic codebook 104 obtained from gain adjustment section 105. This means that two excitations (adaptive codebook 103 and stochastic codebook 104) can be searched using an open loop. In this case, the role of each block (section) is more complex than is described above. This processing procedure is described in detail.

(1) First, gain adjustment section 105 sends excitation samples (adaptive excitation) one after another only from adaptive codebook 103, LPC synthesis section 106 is made to function so as to obtain synthesized sounds, the synthesized sounds are sent to comparison section 107 and are compared with input speech, and optimum code for adaptive codebook 103 is selected. The search is carried out assuming that the gain then has a value that minimizes coding distortion (optimum gain).

(2) Then, code of the adaptive codebook 103 is fixed, and the same excitation sample and excitation samples (stochastic excitations) corresponding to code of comparison section 107 are selected one after another from adaptive codebook 103 and from stochastic codebook 104, and transmitted to LPC synthesis section 106. LPC synthesis section 106 obtains two synthesized sounds, and comparison of the sum of both synthesized sounds and the input speech is carried out at comparison section 107, and code of stochastic codebook 104 is decided. As described above, the selection is carried out assuming that the gain then has a value that minimizes coding distortion (optimum gain).

This open loop search does not use the functions for gain adjustment and addition at gain adjustment section 105.

Compared with the method of search by combining all of the excitations for the respective codebooks, the coding performance deteriorates slightly but the volume of calculations is dramatically reduced to within a feasible range.

In this way, CELP is coding using a model for the vocalization process (vocal chord wave=excitation, vocal tract=LPC synthesis filter) for human speech, and by using CELP as the basic algorithm, it is possible to obtain speech of good sound quality with a comparatively smaller amount of calculations.

Figure 2:
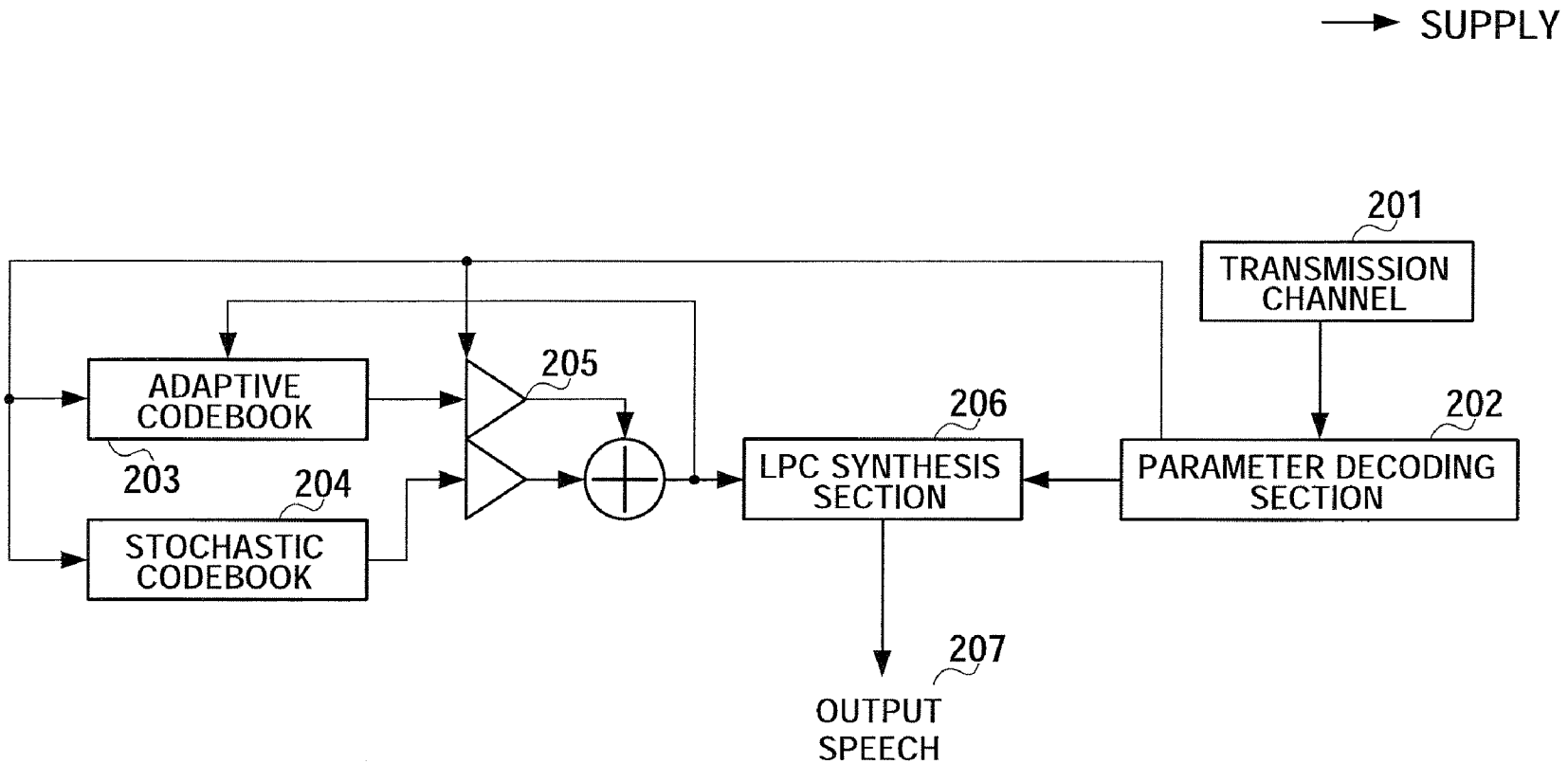
FIG. 2 is a block diagram of CELP decoding apparatus.

Next, a description is given using FIG. 2 of an algorithm for CELP decoding apparatus. FIG. 2 is a block diagram showing CELP scheme decoding apparatus.

Parameter decoding section 202 decodes LPC code sent via transmission channel 201, and obtains LPC parameters for synthesis use for output to LPC synthesis section 206. Further, parameter decoding section 202 sends two excitation codes sent via transmission channel 201 to adaptive codebook 203 and stochastic codebook 204, and designates the excitation samples to be outputted. Moreover, parameter decoding section 202 decodes gain code sent via transmission channel 201 and obtains gain parameters for output to gain adjustment section 205.

Next, adaptive codebook 203 and stochastic codebook 204 output the excitation samples designated by the two excitation codes for output to gain adjustment section 205. Gain adjustment section 205 obtains an excitation vector by multiplying gain parameters obtained from parameter decoding section 202 with excitation samples obtained from two excitation codebooks for output to LPC synthesis section 206.

LPC synthesis section 206 obtains synthesized sounds by carrying out filtering on excitation vectors using LPC parameters for synthesis use and takes this as output speech 207. Furthermore, after this synthesis, a post filter that performs a process such as pole enhancement or high band enhancement based on the parameters for synthesis is often used.

In the above, a description is given of the basic algorithm CELP.

Next, a detailed description is given using the drawings of coding apparatus/decoding apparatus according to a scalable codec of an embodiment of the present invention.

In the present embodiment, a multistage type scalable codec is described as an example. The example described is for the case where there are two layers: a core layer and an enhancement layer.

Moreover, a description is given of a frequency-scaleable example where the speech band of the speech is different, in the case of adding the core layer and enhancement layer as coding conditions for deciding sound quality of a scaleable codec. this mode, in comparison to the speech of a narrow acoustic frequency band obtained with core codec alone, high quality speech of a broad frequency band is obtained by adding the code of the enhancement section. Furthermore, in order to realize "frequency scalable," a frequency adjustment section that converts the sampling frequency of the synthetic signal and input speech is used.

Figure 3:
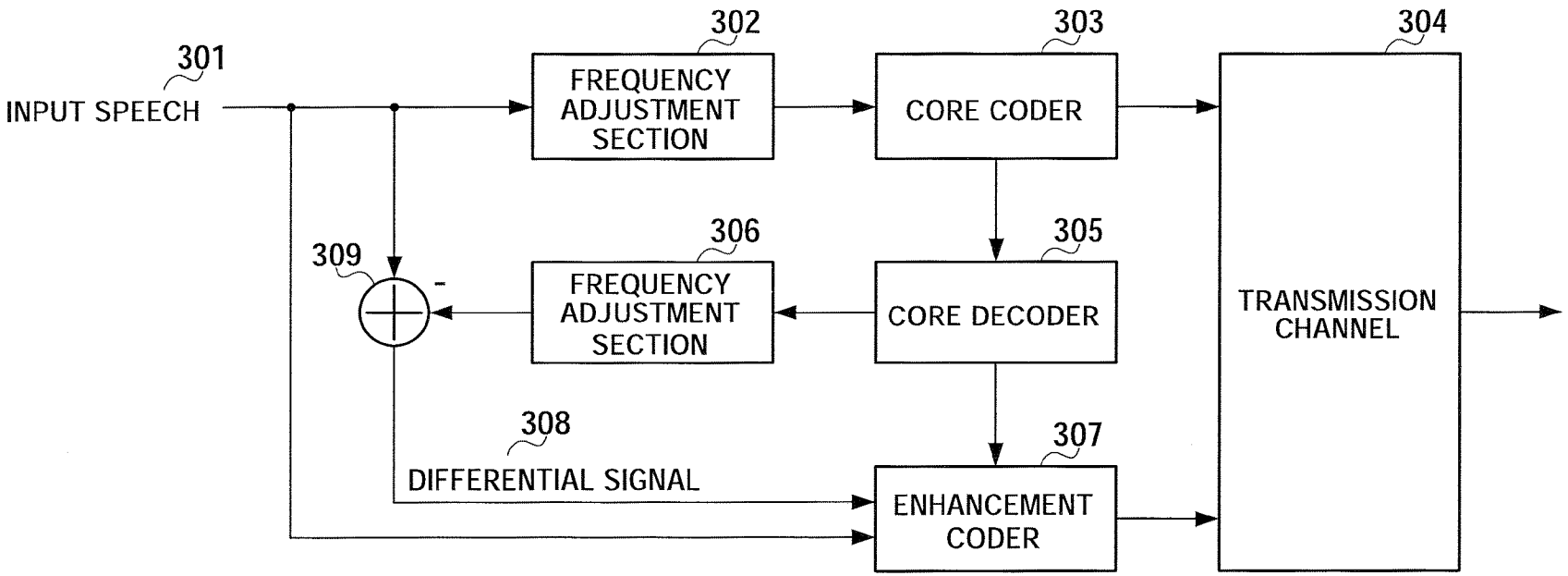
FIG. 3 is a block diagram showing a configuration for coding apparatus according to a scalable codec according to embodiment of the present invention.

In the following, a detailed description is given using FIG. 3 of coding apparatus according to a scalable codec of an embodiment of the present invention. In the description below, as a mode of scaleable codec, an example is used of a scaleable codec referred to as "frequency scaleable" changing the frequency band of the speech signal for the coding target while increasing the bit rate from a narrowband to a broadband.

Frequency adjustment section 302 carries out down-sampling on input speech 301 and outputs an obtained narrowband speech signal to core coder 303. Various down-sampling methods exist, an example being a method of applying a lowpass filter and performing puncturing. For example, in the case of converting input speech sampled at 16 kHz to 8 kHz sampling, a lowpass filter is applied such that the frequency component above 4 kHz (the Nyquist frequency for 8 kHz sampling) becomes extremely small, and an 8 kHz sampled signal is obtained by picking up the signal every other one at a time (i.e. thinning out one for every two) and storing this in memory.

Next, core coder 303 encodes a narrowband speech signal, and outputs the obtained code to transmission channel 304 and core decoder 305.

Core decoder 305 carries out decoding using code obtained by core coder 303 and outputs the obtained synthesized sounds to frequency adjustment section 306. Further, core decoder 305 outputs parameters obtained in the decoding process to enhancement coder 307 as necessary.

Frequency adjustment section 306 carries out up-sampling on synthesized sounds obtained using core decoder 305 up to the sampling rate of the input speech 301 and outputs this to addition section 309. Various up-sampling methods exist, an example being a method of inserting zeros between samples to increase the number of samples, adjusting the frequency component using a lowpass filter and then adjusting power. For example, in the case of up-sampling from 8 kHz sampling to 16 kHz sampling, as shown in equation 1 in the following, first, 0 is inserted every other one so as to obtain signal Yj, and amplitude p per sample is obtained.

[1]

Xi(i=1~I): Output of core decoder A15 (synthesized sounds)

$$Yj = \begin{cases} X\frac{j}{2} & \text{(When } j \text{ is an even number)}(j = 1 \sim 21) \\ 0 & \text{(When } j \text{ is an odd number)} \end{cases} \quad \text{(Equation 1)}$$

$$p = \sqrt{\sum_{i=1}^{1} \frac{Xi \times Xi}{1}}$$

Next, a lowpass filter is applied to Yj, and the frequency component of 8 kHz or more is made extremely small. As shown in equation 2 in the following, with regards to the obtained 16 kHz sampling signal Zi, amplitude q is obtained per sample of Zi, gain is adjusted to be smooth so as to become close to the value obtained in equation 1, and synthesized sound Wi is obtained.

[2]

$$q = \sqrt{\sum_{i=1}^{21} \frac{Zi \times Zi}{21}}$$

Carry out the following processing unit i=1 to 2I $$\begin{cases} g = (g \times 0.99) + \left(\frac{q}{p \times 0.01}\right) \\ Wi = Zi \times g \end{cases} \quad \text{(Equation 2)}$$

In the above, an applicable constant (such as 0) is identified as the initial value of g.

Further, in the event that a filter whereby phase component shift is used at frequency adjustment section 302, core coder 303, and core decoder 305, at frequency adjustment section 306, it is also necessary to adjust the phase component so as to match input speech 301. In this method, the shift in the phase component of the filter up to this time is calculated in advance, and adjustment is made to match phase by applying this inverse characteristic to Wi. By matching phase, it is possible to obtain a pure differential signal with respect to the input speech 301, and it is possible to carry out efficient coding at enhancement coder 307.

Addition section 309 then inverts the sign of the synthesized sound obtained by frequency adjustment section 306 and adds this sound to input speech 301. That is, frequency adjustment section 309 subtracts the synthesized sound from input speech 301. Addition section 309 then outputs differential signal 308 that is a speech signal obtained in this processing, to enhancement coder 307.

Enhancement coder 307 inputs input speech 301 and differential signal 308, carries out efficient coding of the differential signal 308 utilizing parameters obtained at core decoder 305, and outputs the obtained code to transmission channel 304.

The above is a description of coding apparatus according to a scalable codec relating to this embodiment.

Figure 4:
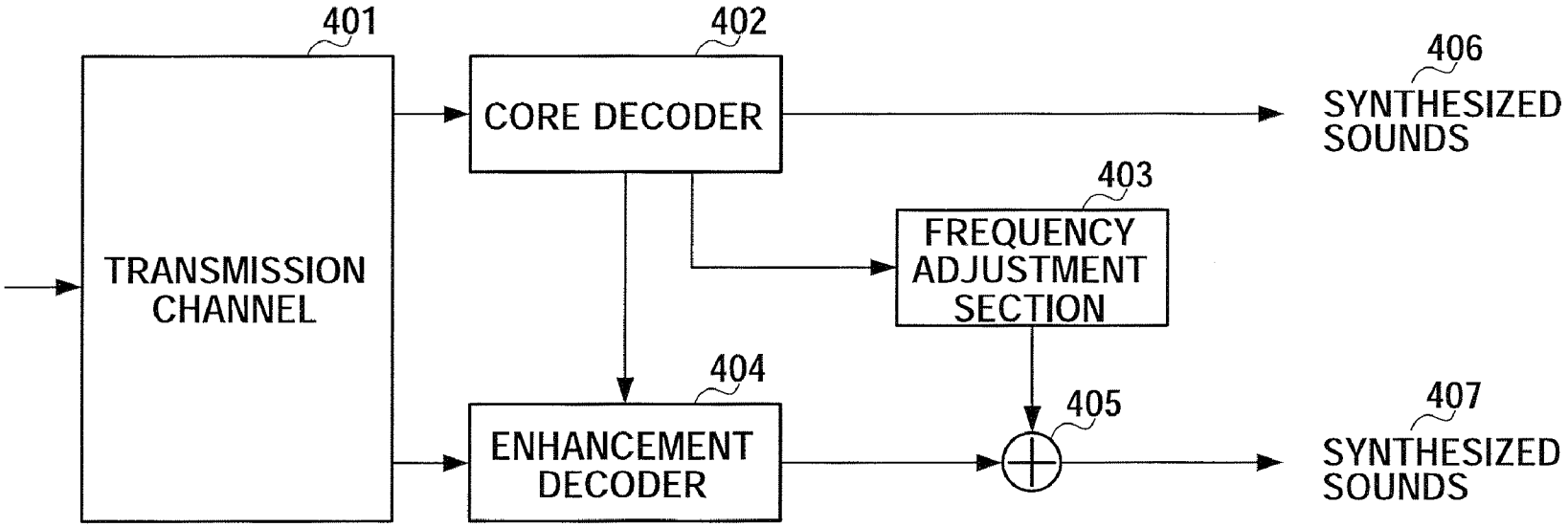
FIG. 4 is a block diagram showing a configuration for decoding apparatus according to a scalable codec of the above embodiment.

Next, a detailed description is given using FIG. 4 of decoding apparatus according to a scalable codec of an embodiment of the present invention.

Core decoder 402 acquires code necessary in decoding from transmission channel 401, carries out decoding, and obtains synthesized sound. Core decoder 402 has the same decoding function as that of core decoder 305 of the coding apparatus of FIG. 3. Further, core decoder 402 outputs synthesized sounds 406 as necessary. It is effective to carry out adjustment on synthesized sounds 406 to make listening easy from an auditory point of view. A post filter using parameters decoded by core decoder 402 is an example. Further, core decoder 402 outputs synthesized sounds to frequency adjustment section 403 as necessary. Moreover, parameters obtained in the decoding process are outputted to enhancement decoder 404 as necessary.

Frequency adjustment section 403 carries out up-sampling on synthesized speech obtained from core decoder 402, and outputs synthesized sounds for after up-sampling to addition section 405. The function of frequency adjustment section 403 is the same as that of frequency adjustment section 306 of FIG. 3 and a description thereof is omitted.

Enhancement decoder 404 decodes code obtained from transmission channel 401 and obtains synthesized sound. Enhancement decoder 404 outputs the obtained synthesized sound to addition section 405. During this decoding, it is possible to obtain synthesized sounds of good quality by carrying out decoding utilizing parameters obtained in the decoding process from core decoder 402.

The addition section 405 adds synthesized sound obtained from frequency adjustment section 403 and synthesized sound obtained from enhancement decoder 404 for output as synthesized sound 407. It is effective to carry out adjustment on synthesized sounds 407 to make listening easy from an auditory point of view. A post filter using parameters decoded by enhancement decoder 404 is an example.

As shown above, it is possible for the decoding apparatus of FIG. 4 to output two synthesized sounds of synthesized sound 406 and synthesized sound 407. Good quality synthesized speech is obtained as a result of synthesized sound 406 only being for code obtained from the core layer and synthesized sound 407 being for code obtained for the core layer and enhancement layer. Which is utilized can be decided according to the system that is to use this scaleable codec. If only synthesized sounds 406 of the core layer are to be utilized in the system, it is possible to omit core decoder 305, frequency adjustment section 306, addition section 309 and enhancement coder 307 of the coding apparatus and frequency adjustment section 403, enhancement decoder 404 and addition section 405 of the decoding apparatus.

A description is given in the above of decoding apparatus according to a scalable codec.

Next, a detailed description is given of a method for utilizing parameters obtained by the enhancement coder and the enhancement decoder from the core decoder for the coding apparatus and decoding apparatus of this embodiment.

Figure 5:
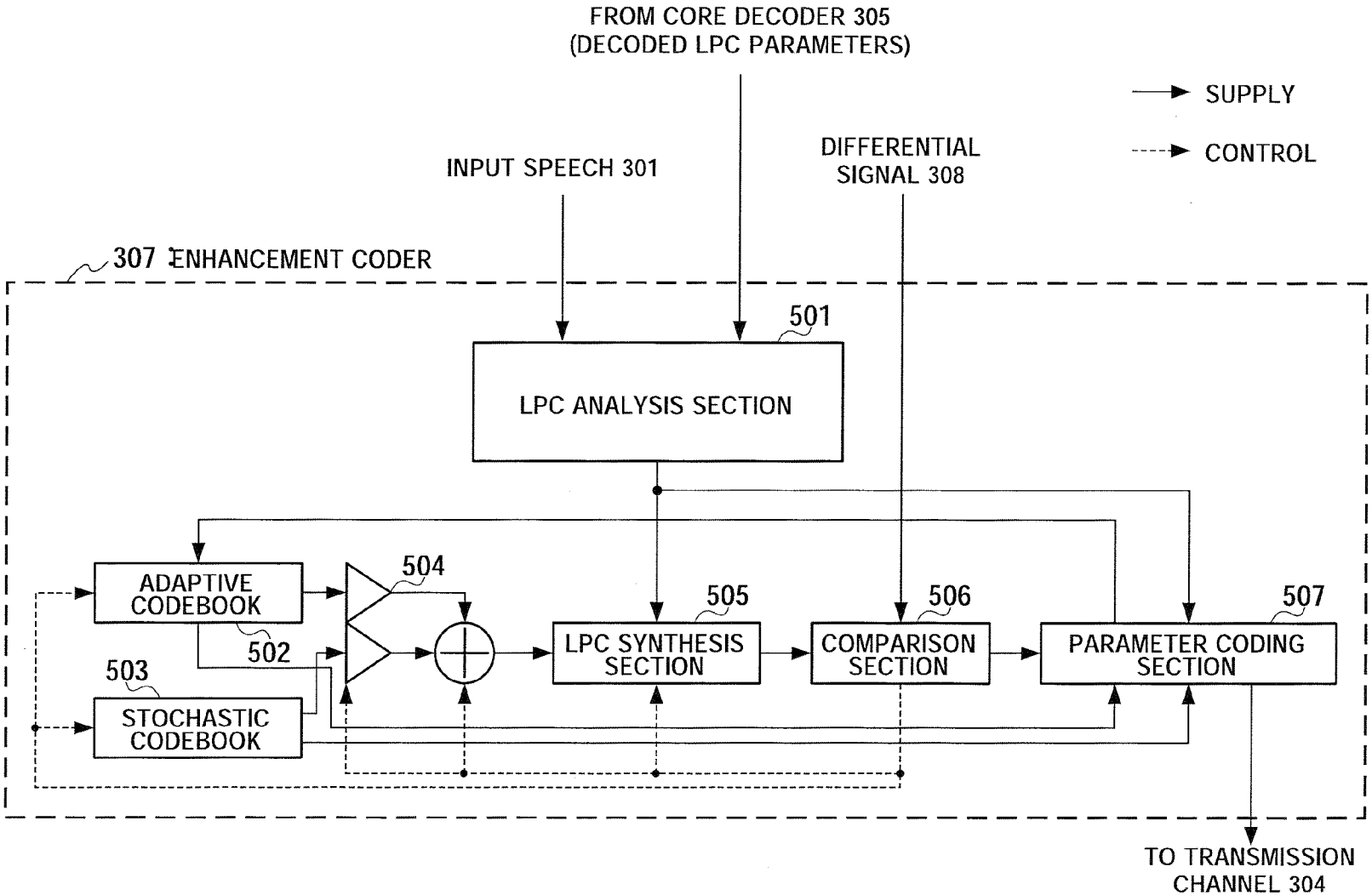
FIG. 5 is a block diagram showing an internal configuration for an enhancement coder for coding apparatus according to a scalable codec of the above embodiment.

Further, using FIG. 5, a detailed description is given of a method for utilizing parameters obtained by enhancement coders for coding apparatus of this embodiment from the core decoder. FIG. 5 is a block diagram showing a configuration for enhancement coder 307 of the scaleable codec coding apparatus of FIG. 3.

LPC analysis section 501 obtains LPC coefficients by carrying out autocorrelation analysis and LPC analysis on input speech 301, obtains LPC code by encoding obtained LPC coefficients, decodes the obtained LPC code and obtains decoded LPC coefficients. LPC analysis section 501 carries out efficient quantization using LPC parameters obtained from core decoder 305. The details of the internal configuration of LPC analysis section 501 are described in the following.

Adaptive codebook 502 and stochastic codebook 503 output excitation samples designated by two excitation codes to gain adjustment section 504.

Gain adjustment section 504 acquires excitation vectors through addition after amplifying the respective excitation samples, with this then being outputted to LPC synthesis section 505.

LPC synthesis section 505 then obtains synthesized sound by carrying out filtering using LPC parameters on the excitation vectors obtained by gain adjustment section 504. However, with actual coding, two synthesized sounds are obtained by carrying out filtering using decoding LPC coefficients obtained using LPC analysis section 501 for two excitation vectors (adaptive excitation, stochastic excitation) for before adjusting gain, with this typically being outputted to comparator 506. This is to carry out more efficient excitation coding.

Next, comparison section 506 calculates the distance between the synthesized sounds obtained at LPC synthesis section 505 and differential signal 308, and searches for a combination of codes of two excitations that give a minimum distance by controlling excitation samples from the two codebooks and amplification in gain adjustment section 504. However, in actual coding, typically coding apparatus analyzes the relationship between differential signal 308 and two synthesized signals obtained in LPC synthesis section 505 to find an optimal value (optimal gain) for the two synthetic signals, adds each synthetic signal respectively subjected to gain adjustment with the optimal gain in gain adjustment section 504 to find a total synthetic signal, and calculates the distance between the total synthetic signal and differential signal 308. Coding apparatus further calculates, with respect to all excitation samples in adaptive codebook 502 and stochastic codebook 503, the distance between differential signal 308 and the many synthetic sounds obtained by functioning gain adjustment section 504 and LPC synthesis section 505, compares the obtained distances, and finds the index of the two excitation samples whose distance is the smallest. As a result, the excitation codes of the two codebooks can be searched more efficiently.

Further, with this excitation search, optimizing the adaptive codebook and the stochastic codebook at the same time is normally not possible due to the amount of calculations involved, and it is therefore typical to carry out an open loop search whereby code is decided one at a time. Namely, code for the adaptive codebook is obtained by comparing synthesized sound for adaptive excitation only and differential signal 308, fixing excitation from this adaptive codebook next, controlling excitation samples from the stochastic codebook, obtaining a large number of total synthesized sounds using combinations of optimized gain, and deciding code for the stochastic codebook by comparing this and differential signal 308. With the procedure described above, it is possible to implement a search with a feasible amount of calculations.

Indexes (codes) for the two codebooks, two synthesized sounds corresponding to the indexes, and differential signal 308 are outputted to parameter coding section 507.

Parameter coding section 507 obtains gain code by carrying out optimum gain coding using correlation of the two synthesized sounds and differential signal 308. Indexes (excitation codes) for excitation samples for the two codebooks are outputted to transmission channel 304 together. Further, an excitation signal is decoded from gain code and two excitation samples corresponding to excitation code and is stored in adaptive codebook 502. During this time, old excitation samples are discarded. Namely, decoded excitation data of the adaptive codebook 502 is backward shifted in memory, old data is discarded, and excitation signals made by decoding in the future are then stored in the portion that becomes empty. This processing is referred to as state updating (update) of an adaptive codebook.

Figure 6:
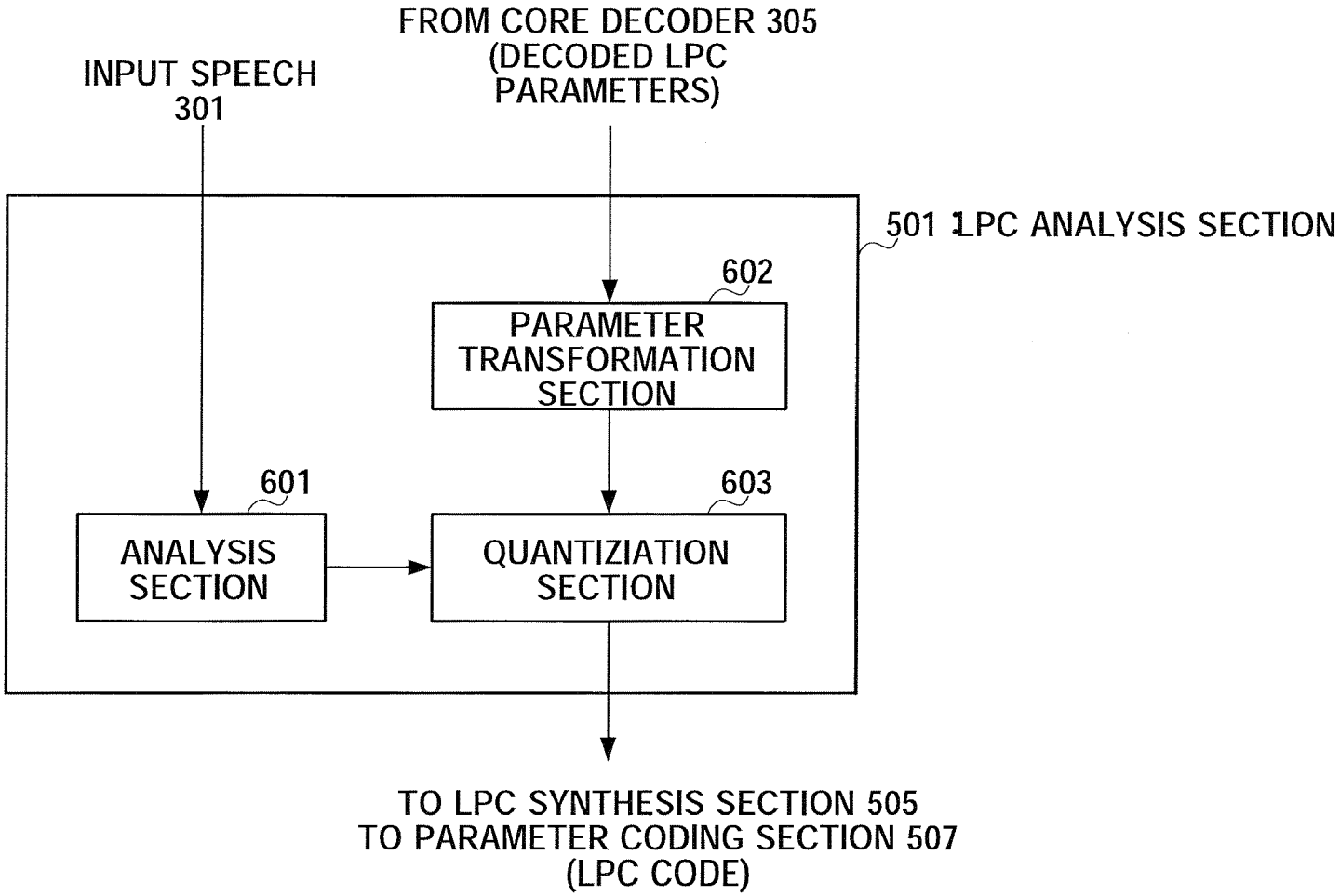
FIG. 6 is a block diagram showing an internal configuration for an LPC analysis section of FIG. 5.

Next, a detailed description is given using the block diagram of FIG. 6 of an internal configuration for LPC analysis section 501. LPC analysis section 501 is mainly comprised of parameter transformation section 602, and quantization section 603.

Analysis section 601 analyzes input speech 301 and obtains parameters. In the case that CELP is the basic scheme, linear predictive analysis is carried out, and parameters are obtained. The parameters are then transformed to parameters that are easy to quantize such as LSP, PARCOR and ISP, and outputted to quantization section 603. Parameter vectors outputted to this quantization section 603 are referred to as "target vectors." It is therefore possible to synthesize speech of good quality at the time of decoding if the parameter vectors are capable of being quantized efficiently using vector quantization (VQ). During this time, it is possible for processing to transform the type and length of parameter at parameter transformation section 602 if the target vector is a parameter vector that is the same type and same length as the decoded LPC parameter. It is also possible to use differential signal 308 as the target of analysis in place of input speech 301.

Parameter transformation section 602 transforms the decoded LPC parameters that are effective in quantization. The vectors obtained here are referred to as "broadband-decoded LPC parameters." In the event that this parameter is a different type from the parameter obtained by analysis section 601 or is a parameter vector of a different length, transformation processing for coordinating the type and length is necessary at the end of processing. The details of the internal processing of parameter transformation section 602 are described in the following.

Quantization section 603 quantizes target vectors obtained from analysis section 601 using broadband-decoded LPC parameters to obtain LPC code.

In the following, a description is given of two quantization modes as an example of quantization using decoded LPC parameters. In the following description, a description is given assuming that the target vectors and the broadband-decoded LPC parameters are parameter vectors of the same type and same length.

(1) The case of encoding the difference from core coefficients (2) The case of encoding using predictive VQ including core coefficients First, a description is given of the mode of quantization of (1).

Firstly, the LPC coefficient that is the target of quantization is transformed to a parameter (hereinafter referred to as "target coefficient") that is easy to quantize. Next, a core coefficient is subtracted from the target coefficient. This is vector subtraction as a result of both being vectors. The obtained differential vector is then quantized by vector quantization (predictive VQ, multistage VQ). At this time, the method of simply obtaining a differential is also effective, but rather than just obtaining a differential, if subtraction is carried out according to this correlation at each element of the vector, it is possible to achieve more accurate quantization. An example is shown in the following equation 3.

[3]

$$Di=Xi-\beta i\cdot Yi \quad \text{(Equation 3)}$$

Di: Differential vector, Xi: Target coefficient, Yi: Core coefficient,

βi: Correlation

In equation 3 described above, βi is obtained in advance statistically, stored, and then used. There is also a method of fixing βi=1.0 but this case is also a simple differential. Deciding the correlation takes place at encoding apparatus for the scaleable codec for a large amount of speech data in advance, and is achieved by analyzing correlation of a large number of target coefficients and core coefficients inputted to LPC analysis section 501 of enhancement coder 307. This is implemented by obtaining βi that makes differential power E of the following equation 4 a minimum.

[4]

$$E = \sum_t \sum_i Dt, i^2 = \sum_t \sum_i (Xt, i - \beta i - Yt, i)^2 \quad \text{(Equation 4)}$$

*tSample* number

Then, βi, which minimizes the above, is obtained by equation (5) below based on the characteristic that all i values become 0 in an equation that partially differentiates E by βi.

[5]

$$\beta i = \frac{\sum Xt, i \cdot Yt, i}{\sum Yt, i \cdot Yt, i} \quad \text{(Equation 5)}$$

It is therefore possible to achieve more accurate quantization by determining the differential using βi described above.

Next, a description is given of the mode of quantization of (2).

Here, predictive VQ is the same as vector quantization after the above differentiation, and is the differential of that for which the product sum is extracted using a fixed prediction coefficient using a plurality of past decoded parameters, subjected to vector quantization. This differential vector is shown in equation 6 in the following.

[6]

$$Di = Xi - \sum_m \delta m,i \cdot Ym,i \quad \text{(Equation 6)}$$

*Di*: Differential vector,

*Xi*: Target coefficient,

*Ym,i*: Past decoding parameter

*δm,i*: Prediction coefficient(fixed)

Two methods exist for the "past decoded parameters," a method of using decoded vectors themselves, and a method of using centroids occurring in vector quantization. The former gives better prediction performance, but, in the latter, error is spread over a longer period, and the latter is therefore more robust with regards to bit error.

Here, if it is ensured that a core coefficient is always contained in Ym, i, the core coefficient has a high degree of correlation using parameters for this time, it is possible to obtain a high prediction performance, and it is possible to achieve more accurate quantization than the mode of quantization of (1) above. For example, in the case of using a centroid, and in the case that the prediction order is 4, then the following equation 7 applies.

[7]

Y0,i: Core efficient

Y1,i: One previous centroid (or normalized version of centroid)

Y2,i: Two previous centroid (or normalized version of centroid)

Y3,i: Three previous centroid (or normalized version of centroid)

$$\text{Normalization: Multiply with } \frac{1}{\left(1 + \sum_m \beta m, 1\right)} \quad \text{(Equation 7)}$$

in order to match dynamic ranges

Further, the prediction coefficients δm, i, similar to βi of the quantization mode of (1), can be found based on the fact that the value of an equation where the error power of many data is partially differentiated by each prediction coefficient will be zero. In this case, the prediction coefficients δm, i are found by solving the linear simultaneous equation of m.

Efficient encoding of LPC parameters can be achieved by using core coefficients obtained using the core layer in the above.

There is also the case where a centroid is contained in the product sum for prediction as the state for the predictive VQ. This method is indicated by the parenthesis in equation 7 and a description is therefore omitted.

Further, in the description of analysis section 601, input speech 301 is used as the target of analysis but it is also possible to extract parameters and implement coding using the same method using differential signal 308. This algorithm is the same as in the case of using input speech 301 and is not described.

The above and the following describe quantization using decoded LPC parameters.

Figure 7:
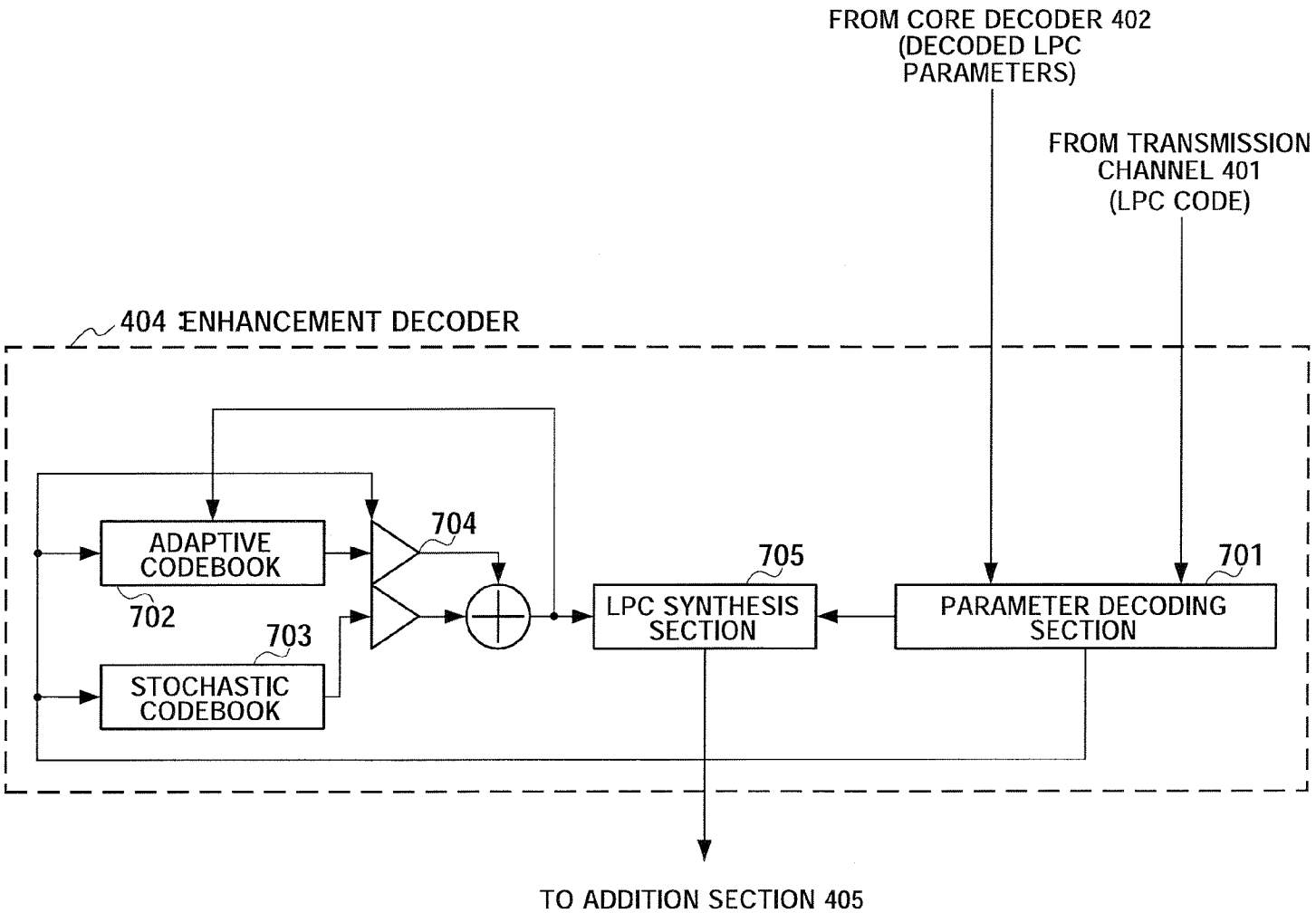
FIG. 7 is a block diagram showing an internal configuration for an enhancement decoder for decoding apparatus according to a scalable codec of the above embodiment.

Next, using FIG. 7, a detailed description is given of a method for utilizing parameters obtained by enhancement decoders for decoding apparatus of this embodiment from the core decoder. FIG. 7 is a block diagram showing a configuration for enhancement decoder 404 of the scaleable codec decoding apparatus of FIG. 4.

Parameter decoding section 701 decodes LPC code and acquires LPC parameters for output to LPC synthesis section 705. Further, parameter decoding section 701 sends two excitation codes to adaptive codebook 702 and stochastic codebook 703 and designates excitation samples to be outputted. Moreover, parameter decoding section 701 decodes optimum gain parameters from gain parameters obtained from the gain code and the core layer for output to gain adjustment section 704.

Adaptive codebook 702 and stochastic codebook 703 output excitation samples designated by two excitation indexes for output to gain adjustment section 704. Gain adjustment section 704 multiplies and adds gain parameters obtained from parameter decoding section 701 with excitation samples obtained from two excitation codebooks for output so as to obtain a total excitation for output to LPC synthesis section 705. Further, the synthesized excitation is then stored in adaptive codebook 702. During this time, old excitation samples are discarded. Namely, decoded excitation data of the adaptive codebook 702 is shifted backward in memory, old data that does not fit in the memory is discarded, and the synthesized excitation made by decoding made in future is then stored in the portion that becomes empty. This processing is referred to as state updating of an adaptive codebook.

LPC synthesis section 705 then obtains finally decoded LPC parameters from parameter decoding section 701, carries out filtering using the LPC parameters at the synthesized excitation, and obtains synthesized sound. The obtained synthesized sound is then outputted to addition section 405. After synthesis, it is typical to use a post filter using the same LPC parameters to make the speech easier to hear.

Figure 8:
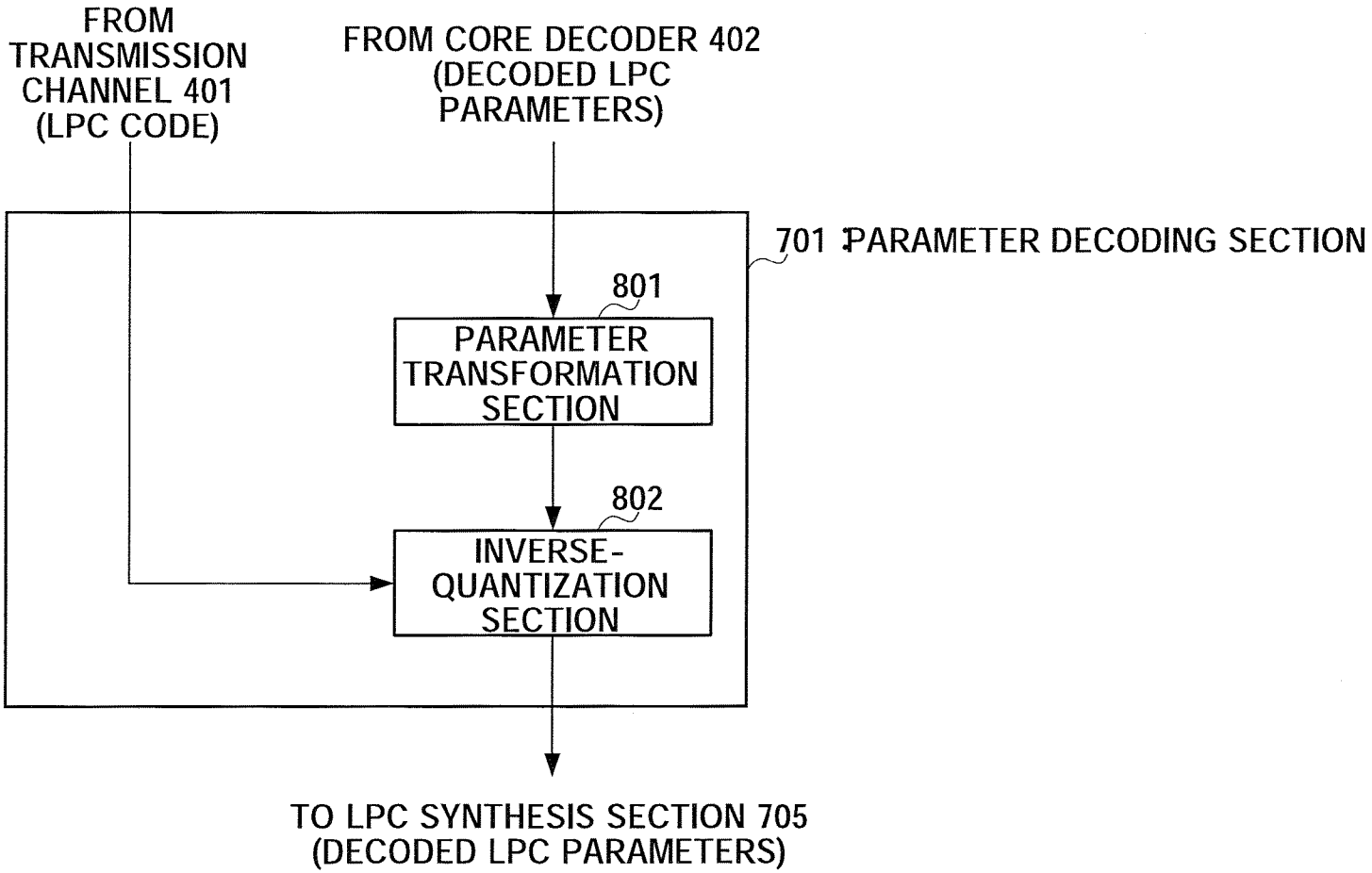
FIG. 8 is a block diagram showing an internal configuration for a parameter decoding section of FIG. 7.

FIG. 8 is a block diagram showing a configuration relating to an LPC parameter decoding function, of the internal configuration for parameter decoding section 701 of this embodiment. A method of utilizing decoded LPC parameters is described using this drawing.

Parameter transformation section 801 transforms the decoded LPC parameters to parameters that are effective in decoding. The vectors obtained here are referred to as "broadband-decoded LPC parameters." In the event that this parameter is a different type from the parameter obtained by analysis section 601 or is a parameter vector of a different length, transformation processing for coordinating the type and length is necessary at the end of processing. The details of the internal processing of parameter transformation section 801 are described in the following.

Inverse quantization section 802 carries out decoding using centroids obtained from codebooks while referring to LPC code and using broadband-decoded LPC parameters and obtains decoded LPC parameters. As described above for on the coder side, the LPC code is code obtained by subjecting parameters that are easy to quantize such as PARCOR and LSP etc obtained through analysis of the input signal to quantization such as vector quantization (VQ) etc. and carries out decoding corresponding to this coding. Here, as an example, a description is given of the following two forms of decoding as for on the coder side. (1) The case of encoding the difference from core coefficients (2) The case of encoding using predictive VQ including core coefficients First, with the mode of quantization for (1), decoding takes place by adding differential vectors obtained using decoding (decoding of that coded using VQ, predictive VQ, split VQ, and multistage VQ) of LPC code at core coefficients. At this time, a method of simply adding is also effective but in the case of using quantization by subtracting according to correlation at each element of the vector, addition is carried out accordingly. An example is shown in the following equation 8.

[8]

$$Oi = Di + \beta i \cdot Yi \quad \text{(Equation 8)}$$

Oi: Decoded vector, Di: Decoded differential vector, Yi: Core efficient

βi: Correlation

In equation 8 described above, βi is obtained in advance statistically, stored, and then used. This degree of correlation is the same value as for the coding apparatus. This obtaining method is exactly the same as that described for LPC analysis section 501 and is therefore not described.

In the quantization mode of (2), a plurality of decoded parameters decoded in the past are used, and the sum of the products of these parameters and a fixed prediction coefficient are added to decoded difference vectors. This addition is shown in equation 9.

[9]

$$Oi = Di + \sum_m \delta m,i + Ym,i \quad \text{(Equation 9)}$$

$Oi$: Decoded vector, $Di$: Decoded differential vector $Ym,i$: Past decoded parameter, $\delta m,i$: Prediction coefficient(fixed)

There are two methods for "past decoded parameters" described above, a method of using decoded vectors decoded in the past themselves, and a method of using a centroid (in this case, a differential vector decoded in the past) occurring in vector quantization. Here, as with the coder, if it is ensured that a core coefficient is always contained in Ym, i, the core coefficient has a high degree of correlation using parameters for this time, it is possible to obtain a high prediction performance, and it is possible to decode vectors with a still higher accuracy than for the mode of quantization of (1). For example, in the case of using a centroid, in the case of a prediction order of 4, this is as in equation 7 using the description for the coding apparatus (LPC analysis section 501).

Efficient decoding of LPC parameters can be achieved by using core coefficients obtained using the core layer in the above.

Figure 9:
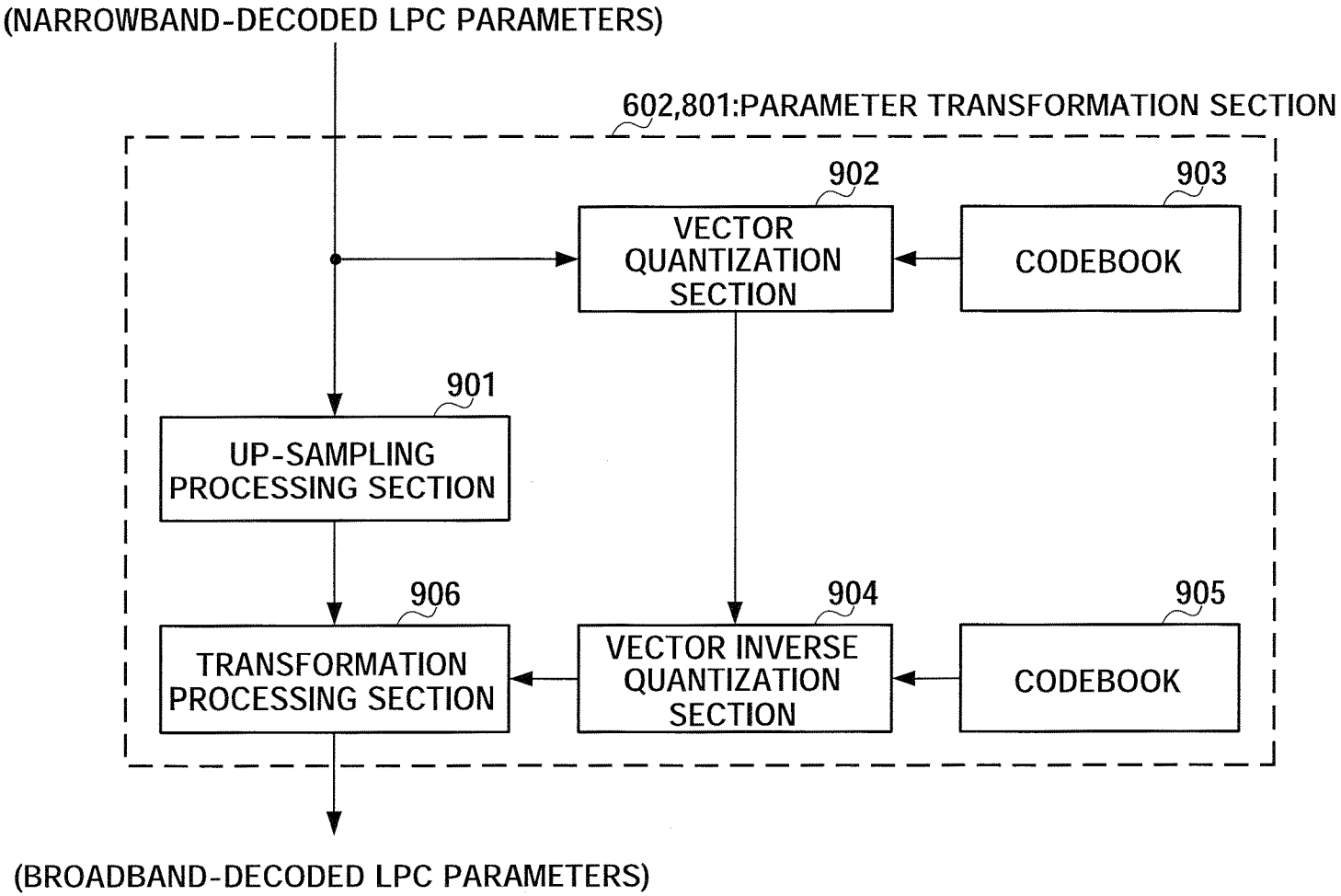
FIG. 9 is a block diagram showing an internal configuration for a parameter transformation section of FIG. 6 and FIG. 8.

Next, a description is given of the details of parameter transformation sections 602 and 801 of FIG. 6 and FIG. 8 using the block diagram of FIG. 9. Parameter transformation section 602 and parameter transformation section 801 have exactly the same function, and transform narrowband-decoded LPC parameters (reference vectors) to broadband-decoded parameters (reference vectors for after transformation).

In the description of this embodiment, a description is given taking the frequency-scaleable case as an example. Further, a description is also given of the case of using transformation of sampling rate as the section for changing the frequency component. Moreover, the case of doubling the sampling rate is described as a specific example.

Up-sampling processing section 901 carries out up-sampling of narrowband-decoded LPC parameters. As an example of this method, a method is described where LPC parameters referred to as PARCOR, LSP, ISP are utilized as autocorrelation coefficients that are reversible, up-sampling takes place for the autocorrelation function, and the original parameters are returned as a result of reanalysis. (the degree of the vectors typically increases)

First, decoded LPC parameters are transformed to α parameters occurring in linear predictive analysis. The α parameters are obtained using the Levinson-Durbin algorithm using usual autocorrelation analysis but the processing of this recurrence formula is reversible, and the α parameters can be converted to autocorrelation coefficients by inverse transformation. Here, up-sampling may be realized with this autocorrelation coefficient.

Given a source signal Xi for finding the autocorrelation coefficient, the autocorrelation coefficient Vj can be found by the following equation (10).

[10]

$$Vj = \sum_i Xi \cdot Xi - j \quad \text{(Equation 10)}$$

Given that the above Xi is a sample of an even number, the above can be written as shown in equation (11) below.

[11]

$$Vj = \sum_i X2i \cdot X2i - 2j \quad \text{(Equation 11)}$$

Here, when the autocorrelation function for the case of doubling the sampling is Wj, the order of the even numbers and odd numbers becomes different, and this gives the following equation 12.

[12]

$$W2j = \sum_i X2i \cdot X2i - 2j + \sum_i X2i + 1 \cdot X2i + 1 - 2j \quad \text{(Equation 12)}$$

$$W2j + 1 = \sum_i X2i \cdot X2i - 2j - 1 + \sum_i X2i + 1 \cdot X2i + 1 - 2j - 1$$

Here, when multi-layer filter Pm is used to interpolate X of an odd number, the above two equations (11) and (12) change as shown in equation (13) below, and the multi-layer filter interpolates the value of the odd number from the linear sum of X of neighboring even numbers.

[13]

$$W2j = \sum_{l} X2i \cdot X2i - 2j + \sum_{l}\left(\sum_{m} Pm \cdot X2(i+m)\right) \cdot \left(\sum_{n} Pn \cdot X2(i+n) - 2\right) = Vj + \sum_{m}\sum_{n} Vj + m - n \quad \text{(Equation 13)}$$

$$W2j+1 = \sum_{l} X2i \cdot \sum_{m} Pm \cdot X2(i+m) - 2(j+i) + \sum_{i}\sum_{m} Pn \cdot X2(i+m) \cdot X2i - 2j = \sum_{m} Pm(Vj+1-m+Vj+m)$$

Thus, if the source autocorrelation coefficient Vj has the required order portion, the value can be converted to the autocorrelation coefficient Wj of sampling that is double the size based on interpolation. α parameters subjected to sampling rate adjustment that can be used with enhancement layers can be obtained by again applying the Levinson-Durbin algorithm to the obtained Wj. This is referred to as a "sampling-adjusted decoded LPC parameter."

Vector quantization section 902 the acquires the numbers of the vectors corresponding to the narrowband-decoded LPC parameter bandwidth from within all of the code vectors stored in codebook 903. Specifically, vector quantization section 902 obtains the Euclidean distances (sum of the squares of the differences of the elements of a vector) between all of the code vectors stored in codebook 903 and the narrowband-decoded, vector-quantized LPC parameters, and obtains numbers for code vectors such that this value becomes a minimum.

Vector inverse quantization section 904 refers to the code vector numbers obtained at vector quantization section 902, and selects code vectors (hereinafter "acting code vectors") from codebook 905 for output to transformation processing section 906. At this time, the performance due to code vectors stored in codebook 905 changes and this is described in the following.

Transformation processing section 906 obtains broadband-decoded LPC parameters by carrying out operations using sampling-adjusted decoded LPC parameters obtained from up-sampling processing section 901 and operation code vectors obtained from vector inverse quantization section 904. These two vector operations change according to the properties of the acting code vectors. This is described in the following.

Here, a detailed description is given in the following of acting code vectors selected from codebook 905 by vector inverse quantization section 904, the function of transformation processing section 906, the results, and a method for making the codebooks 903 and 905, in the case of taking the example of code vectors stored in codebook 905 (differential vectors).

In the event that the acting code vectors are differential vectors, at transformation processing section 906, broadband-decoded LPC parameters are obtained by adding sampling-adjusted decoded LPC parameters and operation code vectors at transformation processing section 906.

Figure 10:
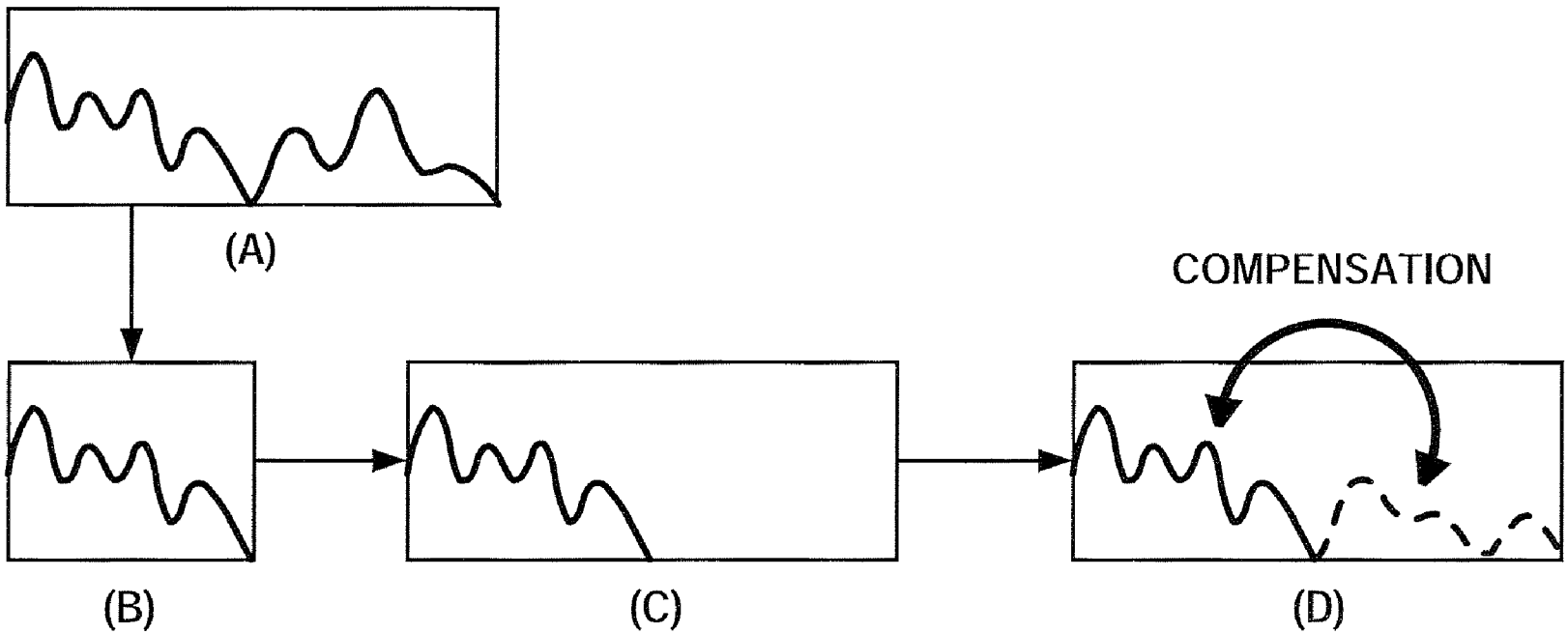
FIG. 10 is a view illustrating processing for a parameter transformation section of FIG. 6 and FIG. 8.

In this method, it is possible to obtain the same results as for interpolation over the frequency spectrum. When it is taken that the frequency component of the first input signal (broadband) prior to coding is as shown in FIG. 10(A), the core layer is subjected to frequency adjustment (down-sampling) prior to this input and is therefore narrowband. The frequency component of the decoded LPC parameter is as shown in FIG. 10(B). The case of up-sampling processing of this parameter (double in this embodiment) yields the spectrum shown in FIG. 10(C). The frequency bandwidth is doubled but the frequency component itself does not change which means that there is no component in the high band. Here, the characteristic that high band components can be predicted to a certain extent from the low band components is broadly known and prediction of and interpolation for the high band region is possible as shown in FIG. 10(D) by using some kind of transformation. This method is referred to as "broadbanding," and this is one type of SBR (Spector Band Replication) that is a method of standard band enhancement for MPEG. Parameter transformation sections 602 and 801 of the present invention present ideas where methods for the above spectra are applied and associated to parameter vectors themselves, and the effect of this is clear from the above description. Showing the association with LPC analysis section 501 of FIG. 6, FIG. 10(A) corresponds to LPC parameters for quantization targets inputted to quantization section 603, FIG. 10(B) corresponds to narrowband-decoded LPC parameters, FIG. 10(C) corresponds to sampling-modulated decoded LPC parameters that are the output of up-sampling processing section 901, and FIG. 10(D) corresponds to the broadband-decoded LPC parameters that are the output of transformation processing section 906.

Next, a description is given of a method for making codebook 903. Code vectors stored in codebook 903 represent space for the whole of inputted decoded LPC parameters. First, a large number of decoded LPC parameters are obtained by having a coder act on a large amount of input data for learning use. Next, a designated number of code vectors are obtained by applying a clustering algorithm such as the LBG (Linde-Buzo-Gray) algorithm etc. to this database. These code vectors are then stored and codebook 903 is made. The inventor confirms that the results of the present invention are obtained if there are 128 code vectors or more through experimentation.

Next, a description is given of a method for making codebook 905. For the code vector stored in codebook 905, a differential vector is statistically obtained for which the error is a minimum in, for each code vector stored in codebook 903. First, a large number of "sampling-adjusted decoded LPC parameters" and corresponding "quantization target LPC parameters" inputted to quantization section 603 are obtained as a result of a coder acting on a large amount of input data for learning use, with a database being made from these "every number" outputted at vector inverse quantization section 904. Next, a group of error vectors is obtained for the database for each number by subtracting corresponding "sampling-adjusted decoded LPC parameters" from each "quantization target LPC parameter" for databases for each number. The average for these error vectors is then obtained and is used as the code vector for this number. This code vector is then stored and codebook 905 is made. This code vector is a group of differential vectors where the "sampling-adjusted decoded LPC parameters" become closest to the "quantization target LPC parameters" in data for learning use.

From the two codebooks described above, it is possible to obtain broadband-decoded LPC parameters with a small error, and coding/decoding with a good efficiency is possible at quantization section 603 and inverse quantization section 802.

In the above description, the acting code vectors are taken to be "differential vectors" but in the event that this is not differential i.e. the operation code vectors are the same homogenous dimension as "broadband-decoded LPC parameters" and are the same type of vector, the present invention is still effective in the event that transformation processing section 906 makes broadband-decoded LPC parameters using these vectors. In this case, as shown in FIG. 11, up-sampling processing section 901 of FIG. 9 is no longer necessary, and operations (slew of operation code vectors, linear predictive operations, non-linear predictive operations, etc.) using operation code vectors rather than simple addition at transformation processing section 906 are carried out.

In this case, the code vectors stored in codebook 905 are vectors of the same dimension and same type as "broadband-decoded LPC parameters" obtained statistically in such a manner as to give the smallest error for each code vector stored in codebook 903. First, a large number of "sampling-adjusted decoded LPC parameters" and "quantization target LPC parameters" inputted to quantization section 603 corresponding to this are obtained as a result of a coder acting on a large amount of input data for learning use, with a database being made from these "every number" outputted at vector inverse quantization section 904. The average for the vectors every number is then obtained and is used as the code vector for this number. This code vector is then stored and codebook 905 is made. This group of code vectors is a group of vectors where the "sampling-adjusted decoded LPC parameters" become closest to the "quantization target LPC parameters."

Figure 11:
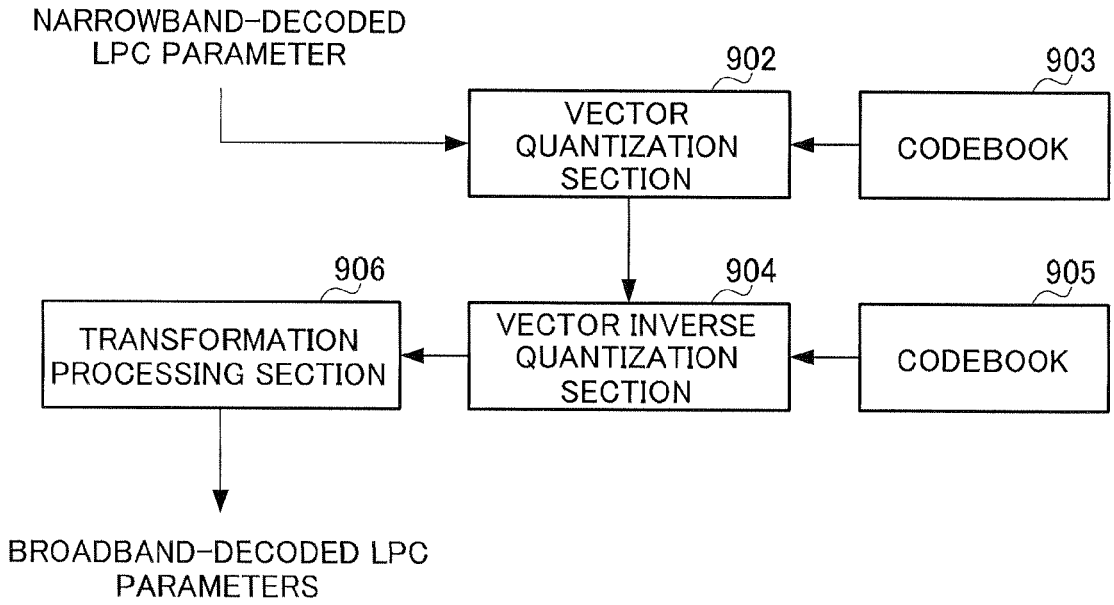
FIG. 11 is another block diagram showing an internal configuration for a parameter transformation section of FIG. 6 and FIG. 8.

In the above case, and in particular in the case of "operation code vector slew," up-sampling processing section 901 is not necessary for FIG. 9 as shown in FIG. 11.

Here, the results of actual coding/decoding are shown numerically. Vector quantization is tested for LSP parameters obtained from a large amount of speech data. This experiment is carried out under the conditions that vector quantization is estimated VQ, and with parameter transformation sections 602 and 801, the size of codebooks 903 and 905 is 128, with differential vectors being stored in codebook 905. As a result, with the present invention, a substantial improvement in the order of 0.1 dB can be confirmed in quantization obtaining a performance of 1.0 to 1.3 dB for a CD (Ceptrstrum distance) under conditions where the present invention is not present. The high degree of effectiveness can therefore be verified.

In the above, according to this embodiment, two different codebooks in the possession of code vectors are prepared, and by carrying out operations using narrowband-decoded LPC parameters and code vectors, it is possible to obtain more accurate broadband-decoded LPC parameters, and it is possible to carry out high performance bandwidth scaleable coding and decoding.

The present invention is not limited to the multistage type, and may also utilize component type lower layer information. This is because differences in the type of input do not influence the present invention.

Figure 12:
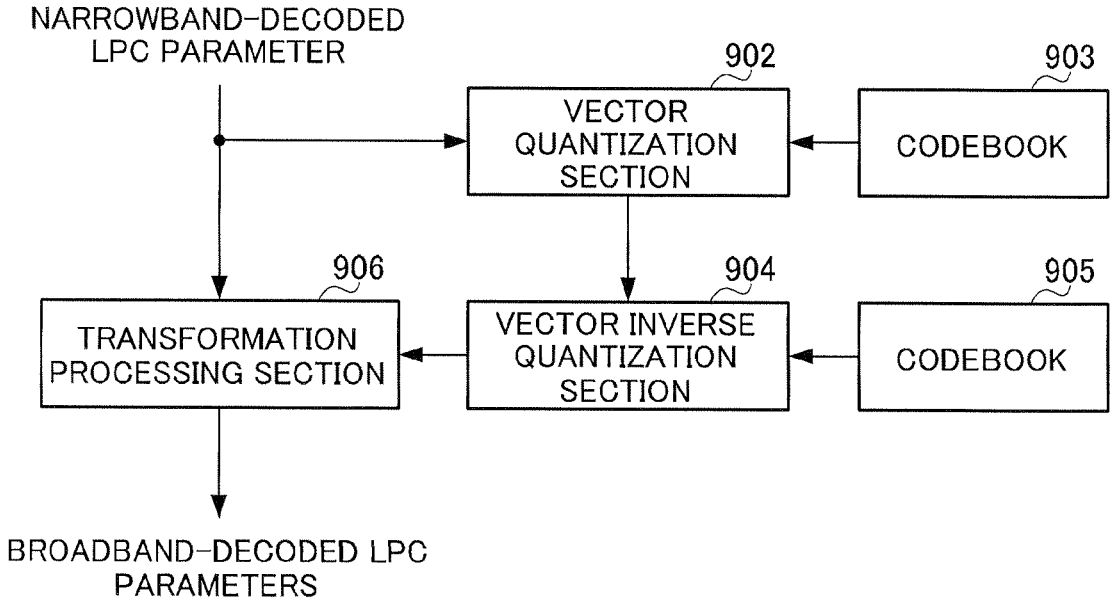
FIG. 12 is a further block diagram showing an internal configuration for a parameter transformation section of FIG. 6 and FIG. 8.

In addition, the present invention is effective even in cases that are not frequency scalable (i.e., in cases where there is no change in frequency). If the frequency is the same, the frequency adjustment sections 302 and 306 and sampling conversion of LPC is unnecessary. This embodiment is easily analogized from the above description. Parameter transformation sections 602 and 801 with the exception of up-sampling processing section 901 are shown in FIG. 12. The method of making codebook 905 in this case is shown below.

The code vector stored in codebook 905 is a statistically obtained differential vector for which the error is a minimum in the case where code vectors are respectively stored in the codebook 903. First, a large number of "decoded LPC parameters" and "quantization target LPC parameters" inputted to quantization section 603 corresponding to this are obtained as a result of a coder acting on a large amount of input data for learning use, with a database being made from these "every number" sent to vector inverse quantization section 904. Next, a group of error vectors is obtained for the database for each number by subtracting corresponding "sampling-adjusted decoded LPC parameters" from each one "quantization target LPC parameter" for databases for each number. The average for these error vectors for each group is then obtained and is used as the code vector for this number. This code vector is then stored and codebook 905 is made. This group of code vectors is a group of differential vectors where the "decoded LPC parameters" become closest to the "quantization target LPC parameters." Further, transformation processing section 906 carries out weighting operations using operation code vectors rather than simple addition.

Further, the present invention may also be applied to methods other than CELP. For example, in the case of layering of speech codecs such as ACC, Twin-VQ, or MP3 etc. or of layering of speech codecs other than MPLPC etc., the latter is the same as that described taking parameters, and the formation is the same as that described for coding/decoding of gain parameters of the present invention in band power coding.

Further, the present invention may be applied to scaleable codecs where the number of layers is two or more. The present invention is also applicable to cases of obtaining information other than LPC, adaptive codebook information, or gain information from a core layer. For example, in the case where information for an SC excitation vector is obtained from a core layer, excitation of the core layer is multiplied by a fixed coefficient and added to an excitation candidate, it becomes clear that it is sufficient to synthesize, search, and encode the obtained excitation used as a candidate.

In this embodiment, a description is given taking an speech signal used as an input signal as a target but the present invention is also compatible with all signals (music and noise, environmental noise, images, and biometric signals such as for fingerprints and iris's) other than speech signals.

This application is based on Japanese patent application No. 2004-321248, filed on Nov. 4, 2004, the entire content of which is expressly incorporated herein by reference.

INDUSTRIAL APPLICABILITY

The present invention is capable of improving the quality of signals including speech by improving vector quantization performance and is appropriate for use in signal processing such as for communication apparatus and recognition apparatus etc.

The invention claimed is:

1. A vector transformation apparatus for transforming a reference vector used in quantization of an input vector, said apparatus comprising:

a first codebook that stores a plurality of first code vectors obtained by clustering vector space;

a vector quantization section that acquires a number of a vector corresponding to the reference vector among the first code vectors stored in the first codebook;

a second codebook that stores second code vectors obtained by performing statistical processing of a plurality of reference vectors for learning use corresponding to a plurality of input vectors for learning use per said number;

a vector inverse quantization section that acquires a second code vector corresponding to the number acquired at the vector quantization section among the second code vectors stored in the second codebook; and a transformation processing section that transforms the second code vector acquired at the vector inverse quantization section to acquire a transformed reference vector, wherein:

the second codebook stores differential vectors previously obtained by performing statistical processing per said number such that a total difference between the input vectors for learning use and the reference vectors for learning use becomes a minimum; and the transformation processing section adds the second code vector acquired at the vector inverse quantization section and the reference vector to acquire the transformed reference vector.

2. The vector transformation apparatus of claim 1, further comprising an up-sampling processing section that up-samples the reference vector, wherein the transformation processing section adds the second code vector acquired at the vector inverse quantization section and the up-sampled reference vector to acquire the transformed reference vector.

3. The vector transformation apparatus of claim 1, wherein the second code vector and the reference vector are assigned weights and added to acquire the transformed reference vector.

4. The vector transformation apparatus of claim 1, wherein the statistical processing comprises averaging.

5. A quantization apparatus that quantizes an input vector using the transformed reference vector obtained by the vector transformation apparatus of claim 1.

6. A vector transformation method for transforming a reference vector used in quantization of an input vector, said method comprising:

a first storage step of storing a plurality of first code vectors obtained by clustering vector space in a first codebook;

a vector quantization step of acquiring a number of a vector corresponding to the reference vector among the first code vectors stored in the first codebook;

a second storage step of storing second code vectors obtained by performing statistical processing of a plurality of reference vectors for learning use corresponding to input vectors for learning use in a second codebook per said number;

a vector inverse quantization step of acquiring the second code vector corresponding to the number acquired in the vector quantization step from the second code vectors stored in the second codebook; and a transformation processing step of transforming the second code vector acquired in the vector inverse quantization step to acquire a transformed reference vector, wherein:

the second codebook stores differential vectors previously obtained by performing statistical processing per said number such that a total difference between the input vectors for learning use and the reference vectors for learning use becomes a minimum; and the transformation processing step comprises adding the second code vector acquired at the vector inverse quantization section and the reference vector to acquire the transformed reference vector.

* * * * *